US010138877B2

(12) United States Patent
Oklejas, Jr.

(10) Patent No.: US 10,138,877 B2
(45) Date of Patent: Nov. 27, 2018

(54) METHOD AND SYSTEM FOR INTENSIFYING SLURRY PRESSURE

(71) Applicant: Vector Technologies, Inc., Monroe, MI (US)

(72) Inventor: Eli Oklejas, Jr., Newport, MI (US)

(73) Assignee: Vector Technologies LLC, Monroe, MI (US)

( * ) Notice: Subject to any disclaimer, the term of this patent is extended or adjusted under 35 U.S.C. 154(b) by 0 days.

(21) Appl. No.: 15/792,855

(22) Filed: Oct. 25, 2017

(65) Prior Publication Data

US 2018/0135606 A1 May 17, 2018

Related U.S. Application Data

(60) Provisional application No. 62/420,622, filed on Nov. 11, 2016.

(51) Int. Cl.
*F04B 9/113* (2006.01)
*F04B 49/22* (2006.01)
(Continued)

(52) U.S. Cl.
CPC ..... *F04B 9/113* (2013.01); *E21B 43/26* (2013.01); *F04B 23/02* (2013.01); *F04B 49/22* (2013.01); *F04B 2203/091* (2013.01)

(58) Field of Classification Search
CPC ..... F04B 9/109; F04B 9/115; F04B 9/1178; F04B 15/02; F04B 7/0038; F04B 9/113;
(Continued)

(56) References Cited

U.S. PATENT DOCUMENTS 1,703,605 A * 2/1929 Ballantyne ..... F16L 3/18 138/106
2,296,647 A * 9/1942 McCormick ..... F01B 25/10 417/225
(Continued)

FOREIGN PATENT DOCUMENTS

CA 2712522 A1 2/2012
DE 4022379 A1 1/1991
(Continued)

OTHER PUBLICATIONS

International Search Report for PCT/US2017/060559 dated Feb. 14, 2018, 7 pages.

*Primary Examiner* — Kenneth J Hansen
(74) *Attorney, Agent, or Firm* — Harness, Dickey & Pierce, P.L.C.

(57) ABSTRACT

A pressure intensifier system includes a housing including a piston separating a first volume and a second volume. A high pressure pump, a low pressure manifold are coupled to a drain line and a slurry tank. A plurality of valves comprise a first state coupling the high pressure pump to the first volume and coupling the second volume to the low pressure manifold so a first portion of fluid in the second volume is communicated to the slurry tank and a second portion of the fluid is communicated to the drain. The valves comprise a second state coupling the high pressure pump to the second volume and coupling the first volume to the low pressure manifold so a first portion of fluid in the first volume is in communication with the slurry tank and a second portion of the fluid in first volume is in communication with the drain.

52 Claims, 12 Drawing Sheets

(51) Int. Cl.
*F04B 23/02* (2006.01)
*E21B 43/26* (2006.01)

(58) Field of Classification Search
CPC ..... F04B 23/02; F16K 11/0708; F16K 11/07; E21B 15/00; E21B 17/02; E21B 19/14; F16L 3/26; F16L 59/024; F16M 1/02; F15B 15/1471; F02C 7/20; F05D 2240/90
USPC ..... 417/225, 226, 397; 92/165 R; 248/676, 248/678, 639, 644, 672, 688, 346.01
See application file for complete search history.

(56) References Cited

U.S. PATENT DOCUMENTS

| | | | | | |
|---|---|---|---|---|---|
| 2,970,546 | A * | 2/1961 | White | F01L 25/08 | 417/225 |
| 3,326,135 | A | 6/1967 | Smith | | |
| 3,811,795 | A * | 5/1974 | Olsen | F03C 1/10 | 417/397 |
| 5,462,414 | A * | 10/1995 | Permar | F04B 9/115 | 210/137 |
| 2008/0193299 | A1 * | 8/2008 | Oglesby | F04B 15/02 | 417/53 |
| 2016/0222985 | A1 | 8/2016 | Oklejas, Jr. | | |

FOREIGN PATENT DOCUMENTS

| | | | |
|---|---|---|---|
| GB | 854565 | A | 11/1960 |
| GB | 1420424 | A | 1/1976 |
| JP | S6419185 | A | 1/1989 |
| JP | 3395122 | B2 | 4/2003 |

* cited by examiner

410

| SV 80 | CV 60 | CV 62 | CV 64 | CV 66 | PS 212 | PS 214 | Comments |
|---|---|---|---|---|---|---|---|
| A | O | C | C | O | --- | --- | Barrel 46 pumping, Barrel 42 filling (Fig. 3) |
| A>B | O>C | C>O | C>O | O>C | --- | Yes | SV 80 changing states |
| B | C | O | O | C | --- | --- | Barrel 46 filling, Barrel 42 pumping (Fig. 2) |
| B>A | C>O | O>C | O>C | C>O | Yes | --- | SV 80 changing states |

FIG. 4

METHOD AND SYSTEM FOR INTENSIFYING SLURRY PRESSURE

RELATED APPLICATION

This application is a non-provisional application of provisional application 62/420,622, filed Nov. 11, 2016, the disclosure of which is incorporated by reference herein.

TECHNICAL FIELD

The present disclosure relates generally to a slurry pumping system, and, more specifically, to a method and system for using a tank with a movable partition to enable a continuous process.

BACKGROUND

The statements in this section merely provide background information related to the present disclosure and may not constitute prior art.

Pumping of process fluids are used in many industries Process fluids may be pumped with a various types of pumps that are driven by a drive fluid. A slurry is one type of process fluid. Slurries are typically abrasive in nature. Slurry pumps are used in many industries to provide the slurry into the process. Sand injection for hydraulic fracturing (fracking), high pressure coal slurry pipelines, mining, mineral processing, aggregate processing, and power generation all use slurry pumps. All of these industries are extremely cost competitive. A slurry pump must be reliable and durable to reduce the amount of down time for the various processes.

Slurry pumps are subject to severe wear because of the abrasive nature of the slurry. Typically, slurry pumps display poor reliability, and therefore must be repaired or replaced often. This increases the overall process costs. It is desirable to reduce the overall process costs and increase the reliability of a slurry pump.

Direct acting liquid driven pumps have been developed, in which a high pressure drive fluid is used to pressurize a process fluid by direct contact, or separated by a membrane or piston. The known system described below is used for a slurry as the process fluid.

Hydraulic fracturing of gas and oil bearing formations requires high pressures typically up to 15,000 psi (103421 kPa) with flow rates up to 500 gallons per minute (1892 liters per minute). The total flow rate using multiple pumps may exceed 5,000 gallons per minute (18927 liters per minute).

Various types of pressure intensifiers use moderate pressure drive fluid to pressurize a high pressure process fluid using several pistons or plungers. The drive fluid is often clean water or hydraulic oil and the pumpage is the process fluid, such as slurry.

Referring now to FIG. 1, a slurry pressure amplifier system 10 is illustrated. The system 10 includes a cylinder 12 that has a piston 14 that moves back and forth within the cylinder 12. The cylinder 12 has a longitudinal axis 16. The piston 14 moves in an axial direction. The piston 14 may be coaxial with the cylinder 12. Although the piston 14 and the cylinder 12 are cylindrically shaped, various shapes may be used.

The piston 14 may include a plurality of sealing rings 18 disposed on an edge of the piston 14, the piston 14 divides the cylinder 12 into a first volume 20 and a second volume 22. The sealing rings 18 prevent fluid leakage from between the first volume 20 and the second volume 22 within the cylinder 12. A first port 24 communicates drive fluid into or out of the cylinder 12 at the first volume 20. A second port 26 communicates drive fluid into and out of the second volume 22 within the cylinder 12. The drive fluid may be water or another type of hydraulic fluid.

The cylinder 12 has a cylindrical wall 30, a first end wall 32 and a second end wall 34. That defines the volume of the cylinder. The first end wall 32 has a first opening 36. The second end wall 34 has a second opening 38 therethrough.

The end wall 32 of the cylinder 12 has a seal 40 and a first pump barrel 42 coupled thereto. The seal 40 may be referred to as packing. The second end wall 34 has a seal 44 and a second pump barrel 46 coupled thereto.

The piston 14 has a first plunger 50 that is received within the first opening 36 and the seal 40 and extends into the first pump barrel 42. The second opening 38 in the second end wall 34 receives a second plunger 52. The second plunger 52 extends from the piston 14 through the opening 38, the seal 44 and into the second pump barrel 46. As the piston 14 moves in the axial direction, the plungers 50, 52 move within the respective barrels 42, 46.

The barrels 42, 46 alternatively receive pumpage and pressurize the pumpage. The first pump barrel 42 is in fluid communication with a first check valve 60 and second check valve 62. The barrel 46 is in fluid communication with a third check valve 64 and a fourth check valve 66. The check valves 60, 64 communicate fluid into the respective barrels 42, 46. The check valves 62, 66 communicate fluid out of the respective barrels 42, 46. A low pressure manifold 70 communicates low pressure pumpage such as slurry to the first check valve 60 and the second check valve 64. High pressure pumpage pressurized within the barrels 42, 46 is communicated from the check valves 62 and 66 to a high pressure manifold 72. The high pressure manifold 72 is in communication with a process such as a well head for use and a use in fracking or other suitable use. The low pressure pumpage within the low pressure manifold 70 is increased in pressure due to the pumping action of the plungers 50, 52 and the movement of the piston 14 which acts to increase the pressure of the pumpage as will be described in detail below.

A drive fluid is communicated to the first volume 20 through port 24 and to volume 22 through port 26. The port 24 is in communication with a pipe 74. Port 26 is in communication with a pipe 76. The pipes 74 and 76 are in fluid communication with a plurality of valves. The plurality of valves may be disposed within a single spool valve 80. The spool valve 80 is linearly actuated by a linear actuator 82 that is in communication with the spool valve 80 with a rod 84. The spool valve 80 has a plurality of ports which include a first port 86 and a second port 88. The ports 86 and 88 may act as an inlet and an outlet to the spool valve 80. A plurality of ports 89, 90 and 92 may also be part of the spool valve 80. Ports 89 and 92 are in communication with a hydraulic tank 94. Port 90 is in communication with a high pressure pump 96. Pipes in the form of a manifold 98 may form the interconnections between the ports 89-92 and the tank 94. Pipes 100 and 102 couple the tank 94 to the high pressure pump 96 and the high pressure pump 96 to the port 90, respectively.

The rod 84 is used to move valve disks 110 and 112. The valve disks 110, 112 are illustrated in the rightmost position. In this position, the high pressure pump 96 communicates high pressure drive fluid to the port 90 through the pipe 102. Fluid is communicated through the port 90 to the port 88 through the spool valve 80. The drive fluid is communicated to the port 26 and the first volume 22 of the cylinder 12. The high pressure fluid communicated to the first volume 22 pushes the piston 14 within the cylinder 12 to the left as compared to the drawing in FIG. 1. The first volume 20 is being reduced and communicated from the port 24 through the pipe 74 to the port 86 of the spool valve 80. The low pressure fluid is communicated from port 86 to port 89 through the spool valve 80. The fluid is communicated through the manifold 98 to the tank 94 where it may be reused by the high pressure pump 96.

In a second state of operation of the spool valve 80 (not illustrated), the plurality of valves within the spool valve 80 operate as follows. The rod 84 moves the valve disks 110, 112 to the left. Disk 110 is then between port 89 and port 86. Disk 112 is then positioned between port 90 and port 88. In this manner, high pressure fluid from the high pressure pump 96 is communicated to port 24 and the first volume 20 through the port 86 of the spool valve and pipe 74. Low pressure fluid is returned to the tank 94 from the second volume 22 through port 26, pipe 76, port 88, port 92 and the manifold 98 of the spool valve.

By switching the spool valve 80 between the two states as described above, the fluid pressure drives the piston 14 in an oscillating motion that results in the movement of the plungers 50, 52 into and out of the pump barrels 42, 46, respectively. As the respective plunger 50, 52 withdraws from the respective barrel 42, 46, the appropriate check valve 60 or 64 opens to admit low pressure pumpage, such as slurry, into the barrel. When the direction of the plunger 50, 52 is reversed, the check valves 60, 64 close and the pumpage is pressurized to a high pressure. The high pressure pumpage is communicated to the high pressure manifold 72 through check valves 62 and 66.

To summarize, when high pressure drive fluid is communicated to the second volume 22, fluid is being removed from the first volume 20. The piston 14 moves in a leftward position relative to FIG. 1 and thus the plunger 50 extends into the pump barrel 42 forcing a high pressure pumpage from the check valve 62 into the high pressure pumpage manifold 72. At the same time, the plunger 52 is withdrawing from the pump barrel 46 drawing low pressure pumpage into the barrel 46 through the check valve 64. In the reverse direction, when high pressure drive fluid is communicated to the first volume 20 and low pressure drive fluid is being moved from the second volume 22, the plunger 50 is being withdrawn into the pump barrel 42. This draws in low pressure pumpage through the check valve 60 and closed the check valve 64. At the same time, the pump barrel 42 is pressurizing pumpage by the action of the plunger 52 which is moving in a rightward direction relative to FIG. 1. The check valve 62 is in a closed position while the check valve 66 is in an open position and communicating high pressure pumpage to the high pressure pumpage manifold 72.

SUMMARY

The present disclosure is directed to a method and system that allows abrasive slurries to be injected into a very high pressure process stream with minimal wear. The system provides high reliability due to the reduced amount of wear.

In one aspect of the disclosure, a pressure intensifier system includes a housing comprising a piston therein. The piston defines a first volume and a second volume within the housing. The system further includes a high pressure pump, a low pressure manifold coupled to a drain line and a slurry tank. The plurality of valves selectively couples the high pressure pump to the first volume or the second volume and selectively couple the first volume or second volume to the low pressure manifold. The plurality of valves comprise a first state coupling the high pressure pump to the first volume and coupling the second volume to the low pressure manifold so that a first portion of fluid in the second volume is in communication with the slurry tank and a second portion of the fluid is in communication with the drain. The plurality of valves comprise a second state coupling the high pressure pump to the second volume and coupling the first volume to the low pressure manifold so that a first portion of fluid in the first volume is in communication with the slurry tank and a second portion of the fluid in first volume is in communication with the drain.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 4 is a state diagram of the various valves during operation of the slurry pressure intensifier of FIGS. 2 and 3.

DETAILED DESCRIPTION

Figure 1:
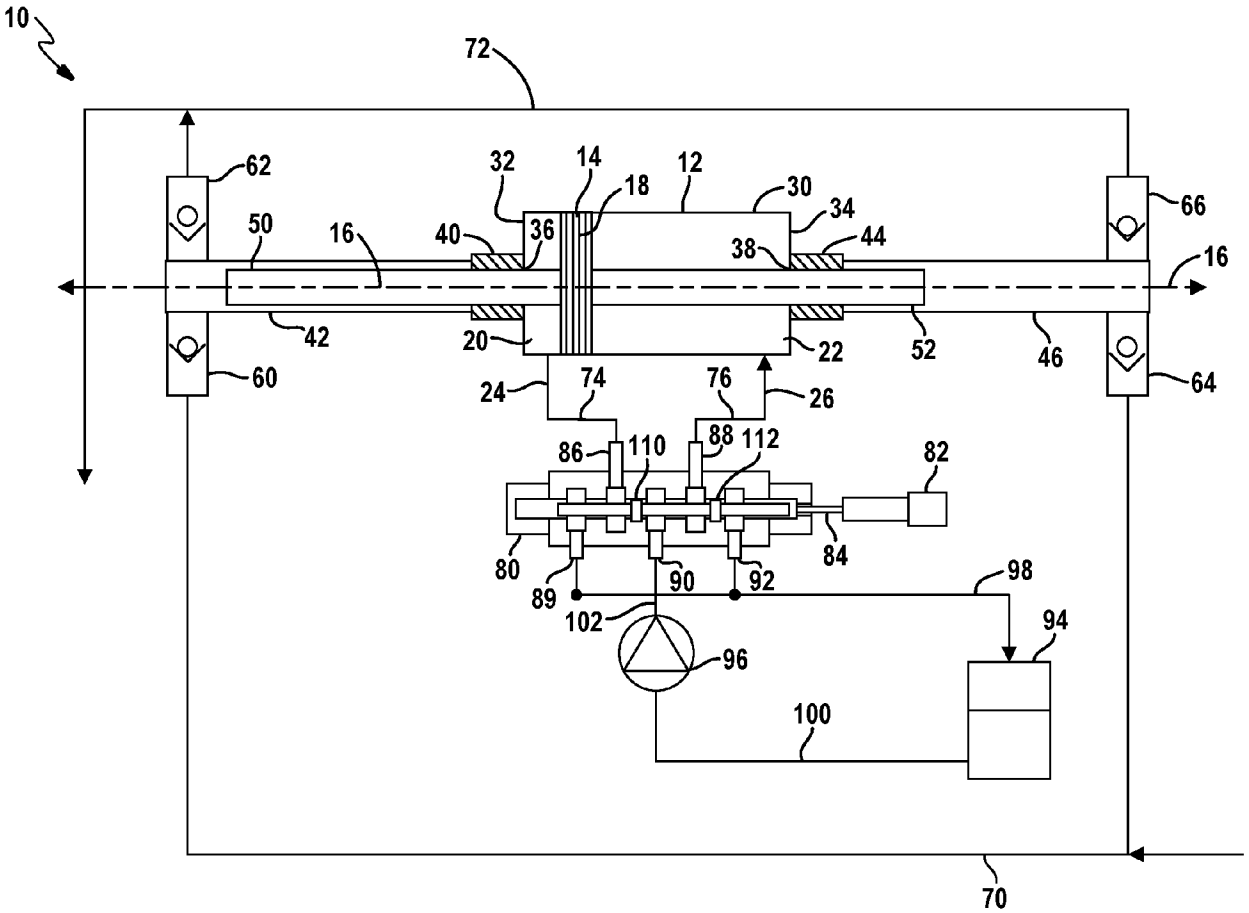
FIG. 1 Prior Art
FIG. 1 is a schematic view of a slurry pressure intensifier according to the prior art.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

In the following description, a transfer of hydraulic energy from a relatively high flow and moderate pressure flow of relatively clear water is generated by a reliable and low cost centrifugal pump to an abrasive slurry stream at a much higher pressure and at a lower flow rate.

Figure 2:
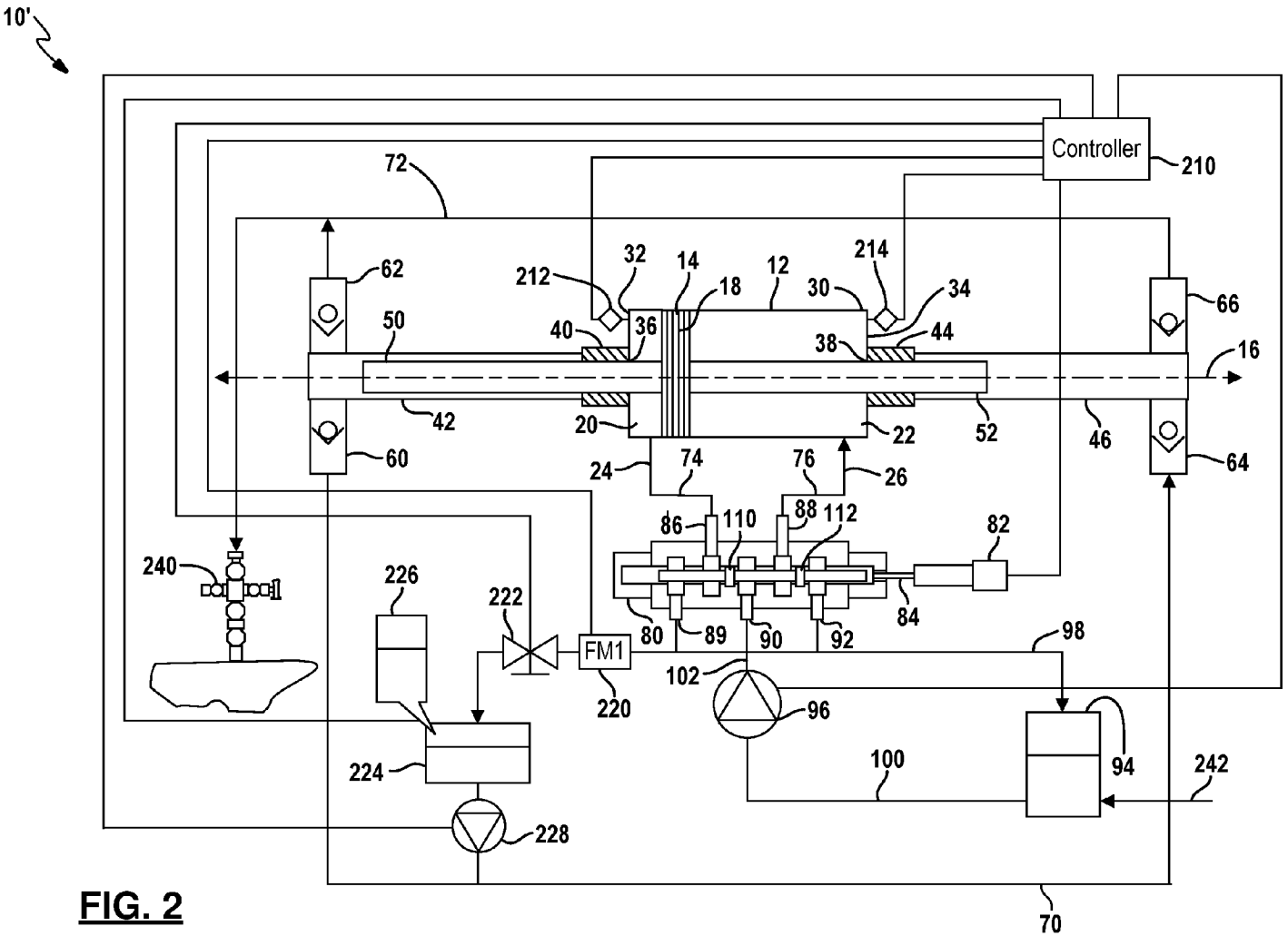
FIG. 2 is a schematic view of an improved slurry pressure intensifier according to the present disclosure.

Referring now to FIG. 2, a slurry pressure amplifier system 10' according to the present disclosure is set forth. In this example, the identical components are labeled the same as those set forth in FIG. 1. In this example, a controller 210 is in communication with various devices set forth in the system 10. For example, the controller 210 may be coupled to proximity sensors 212 and 214. The proximity 212 and 214 are provided to sense the proximity of the piston 14 to the first end wall 32 and the second end wall 34. Thus, the proximity sensors 212, 214 are disposed within or adjacent to the respective end walls 32, 34. The controller 210 may also be coupled to the linear actuator 82 which is actuated in response to feedback from the proximity sensors 212, 214. That is, the state of the spool valve 80 is changed from a first state to a second state as the piston 14 reaches the end walls 32, 34 as sensed by the proximity sensors 212, 214. As illustrated in FIG. 2, the spool valve 80 is in a first state in which drive fluid from the tank 94 is communicated to the second volume 22. When the piston 14 reaches the end wall 32 as is sensed by the sensor 212, drive fluid is communicated to the first volume 20 and removed from the second volume 22 until the piston 14 reaches the end 34 as sensed by the proximity sensor 214. Thereafter, drive fluid is provided to the second volume 22 through port 26 and removed from the first volume 20 through port 24.

In this example, the ports 89 and 92 of the spool valve 80 are in communication with a flow sensor 220 and a flow regulation valve 222. The flow sensor 220 may be a flow meter or a flow rate sensor that is in electrical communication with the controller 210. In response to a desired output, the flow regulation valve 222 may be controlled by the controller 210 in response to the output from the flow sensor 220. The flow regulation valve 222 controls the amount of drive fluid that is communicated to a slurry tank 224. The slurry tank 224 receives dry material from a hopper 226. The hopper 226 may also be controlled by the controller 210. The output of the slurry tank 224 may be communicated to the low pressure slurry manifold 70 through a low pressure pump 228. The high pressure pump 96 and the low pressure pump 228 may also be controlled by the controller 210.

In operation, some of the drive fluid, such as water that is communicated through the manifold 98, may be routed to the slurry tank 224 where it is mixed with dry material from the hopper 226 to form the slurry mixture. Ultimately, the slurry mixture is communicated with a relatively low pressure to the low pressure slurry manifold 70 through the low pressure pump 228. The low pressure slurry is communicated to the check valves 60, 64 so that it may be pressurized by the plungers within the pump barrel as was described earlier. Ultimately, the output of the check valves 62 and 66 are communicated to a well head 240 where the high pressure slurry may be used for an operation such as fracking.

A pipe 242 may communicate fresh drive fluid such as water to the tank 94 during the process to make up for the fluid that leaves the tank 94 during the production of the slurry. It should be noted that recirculated water that is communicated to the tank 94 may have an increased temperature due to the operation of the pump 96. The introduction of fresh water to the tank 94 reduces the overall temperature and allows the temperature to be maintained at an acceptable level.

Figure 3:
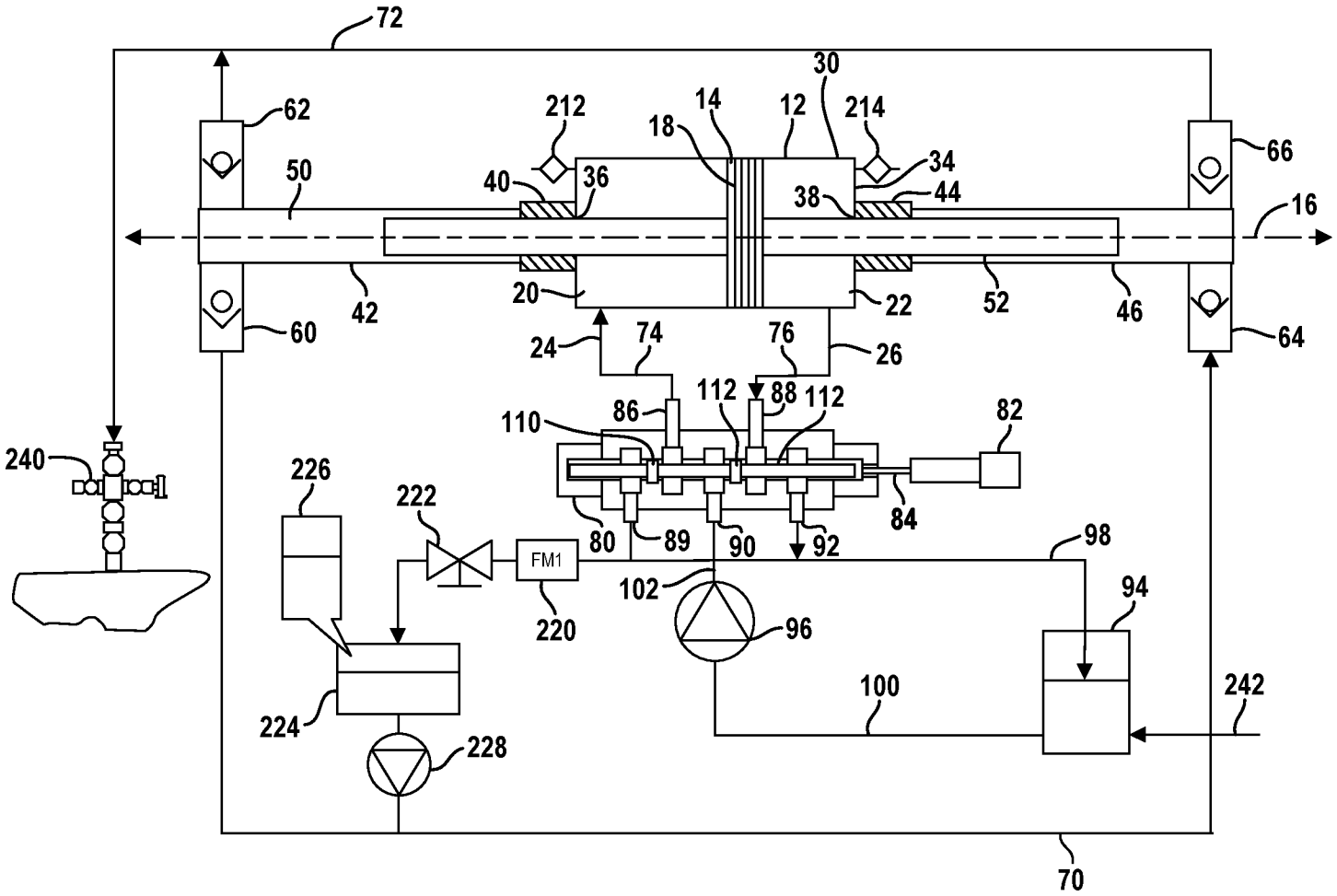
FIG. 3 is a second state of the slurry pressure intensifier of FIG. 2.

Referring now to FIG. 3, the spool valve 80 is illustrated in a second position. That is, the rod 84 is moved leftward or deeper into the spool valve 80 relative to FIG. 3 so that the disks 110 and 112 are between valve ports 86 and 89, and 88 and 90, respectively. In this example, the piston 14 is moving toward the end wall 34. High pressure drive fluid is communicated from the port 86 of the spool valve 80 from the high pressure pump 96. In this example, the high pressure slurry manifold 72 is receiving high pressure slurry from the check valve 66 while low pressure slurry is being received at the barrel 42 through the check valve 60. Check valves 62 and 64 are closed in this phase of the process. The process illustrated in FIG. 3 continues until the piston 14 reaches the end wall 34 which is sensed by the proximity sensor 214.

Referring now to FIG. 4, the operation of the various valves is set forth. In FIG. 4, the states of the spool valve 80, the check valve 60, the check valve 62, the check valve 64, the check valve 66, the proximity sensor 212 and the proximity 214 are set forth. In the first row, the barrel 46 is pumping while barrel 42 is filling. This is illustrated in FIG. 3. In this state, the spool valve is in state A as illustrated in FIG. 3. In FIG. 3, the check valve 60 is open, the check valve 62 is closed, the check valve 64 is closed, the check valve 66 is open and the proximity sensors 212, 214 are not sensing the piston 14 proximate to either end.

In the second row of the chart 4, the spool valve 80 is transitioning from state A to state B. The check valve 60 is changing from open to closed, the check valve 62 is changing from closed to open, the check valve 64 is changing from closed to open, and the check valve 66 is changing from open to closed. In the transition state, the proximity sensor 214 is sensing the piston 14 relative to the second end 34. The proximity sensor 212 is not sensing the piston 14.

In state B, as described in the third row of FIG. 4, the disks 110, 112 of the spool valve 80 are in the position of FIG. 2. The check valve 60 is in a closed position, the check valve 62 is in an open position, the check valve 64 is in an open position and the check valve 66 is in a closed position. In the fourth row of the chart 410, a transition state is being performed when the proximity sensor 212 senses the piston 14 thereby. The check valve 60 is changing from a closed to an open position, the check valve 62 is changing from an open to a closed position, the check valve 64 is changing from an open to a closed position and the check valve 66 is changing from a closed to an open position.

In operation, the slurry flow is 750 gallons per minute (2839 liters per minute) at 12,000 psi (803 bar). The drive flow and the pressure are 3,000 gallons per minute (11,356 liters per minute) at 3045 psi (210 bar). For hydraulic fracturing, the high pressure pump may generate between 1,000-3,000 psi (69-207 bar). The pressure generated by the pump barrels 42 and 46 may be between 5,000 and 15,000 psi (345-1032 bar). The ratio of the area of the piston is 4.0 and the piston pressure is 3,000 psi (204 bar). The plunger pressure is @ 12,000 psi (830 bar). For every four gallons of drive fluid communicated through the drive pressure pump 96, one gallon of slurry (3.78 liters) is pumped by the system 10 from the high pressure slurry manifold 72. The high pressure pump 96 may pump 2,000 gallons per minute (7571 liters per minute) at 1500 psi (103 bar) to deliver 500 gallons per minute (1893 liters per minute) of slurry at 6,000 psi (415 bar). The pump 96 may be a multi-stage centrifugal pump driven by a diesel engine with a speed increaser or a gas turbine with a speed reducer. A centrifugal pump is used for its lightweight, compact, highly reliable and efficient operation.

Figure 5A:
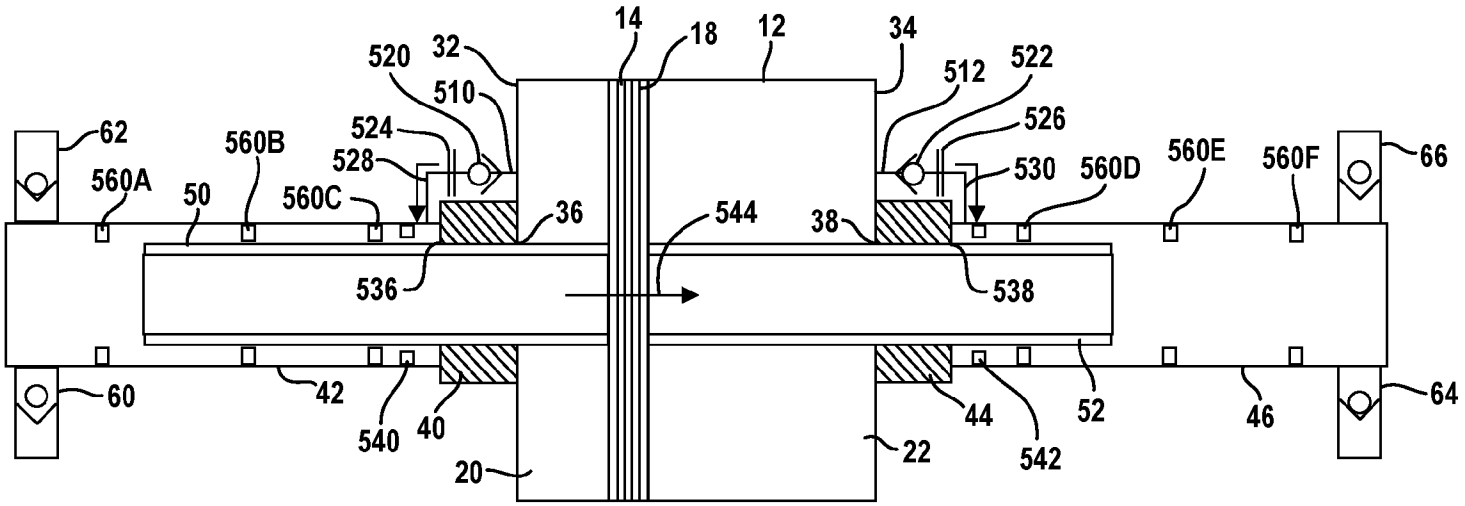
FIG. 5A is a schematic view of an improved piston and plunger assembly according to the disclosure.
Figure 5B:
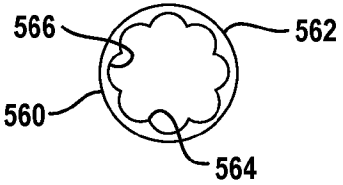
FIG. 5B is a side view of a ring according to the present disclosure.

Referring now to FIGS. 5A and 5B, a portion of the pressure intensifier system 10' illustrated in FIG. 2 is set forth. In this example, the operation of the cylinder 12 relative to the pump barrels 42 and 46 is set forth. In this example, the first end 32 and the second end 34 comprise a first port 510 and a second port 512. Each port 512, 514 is in fluid communication with a check valve 520 and 522, respectively. An orifice 524 and 526 is located in fluid communication with each check valve 520, 522, respectively. The port 510, the check valve 520 and the orifice 524 form a first bypass line 528. The port 512, the check valve 522 and the orifice are formed within a bypass line 530. The outlet of the bypass lines 528 and 530 are at a face 536, 538 of the seals 40 and 44. The orifices 524, 526 limit the flow rate and the check valves 520 and 522 allow flow in a single direction from the first volume 20 or the second volume 22.

In operation, the example set forth in FIG. 5A shows the piston 14 moving in a rightward direction as indicated by the arrow 544. In this example, the volume 20 is highly pressurized whereas volume 22 is at a lower pressure. Correspondingly, the pressure within the barrel 42 is also lower than the pressure within the barrel 46. Barrel 46 is at a high pressure. The output of the bypass line 528 is between the seal 40 and a bushing 540. The output of the bypass line 530 is between the seal 44 and the bushing 542. As the piston 14 moves in the direction indicated by the arrow 544, the higher pressure within the cylinder 12 forces the check valve 520 to open and thus clean drive fluid flushes the area between the bushing 540 and the seal 40. Thus, the face of seal 40 is mostly free of slurry as the plunger 50 travels through the seal 40. This reduces wear on the plunger 50 and seal 40. In the reverse direction, when the plungers 50 and 52 are moving in a direction opposite of the arrow 544, the check valve 44 opens and drive fluid is communicated through the orifice 526 to the space between the seal 44 and the bushing 542. Slurry is cleaned from the face of seal 44 and adjacent to plunger 52. When the cycle reverses, the check valves 520 or 522 close to prevent slurry from flowing into the cylinder 12.

Referring now to FIG. 5B, a plurality of guide rings 560 may be provided within each pump barrel 42, 46. In this example, three guide rings 560A, 560B and 560C are located within the pump barrel 42. Guide rings 560D, 560E and 560F are located within the pump barrel 46. The guide rings may be collectively referred to with reference numeral 560. The guide rings 560 may have an outer surface 562 that conforms with the inner surfaces of the respective pump barrels 42, 46. The inner surface 564 may have a plurality of nodes 566 that extend toward the respective plungers 50, 52 within the pump barrel 42, 46. The guide rings 560 may be fixably attached to the respective pump barrels 42, 46. Because of the rapid change in forces within the pump barrels 42, 46, the guide rings 560 allow the plungers 50, 52 to remain centered within the respective barrels 42, 46. Although three guide rings 560 are illustrated within each barrel 42, 46, greater or fewer numbers of guide rings may be used depending on the various conditions.

Figure 6:
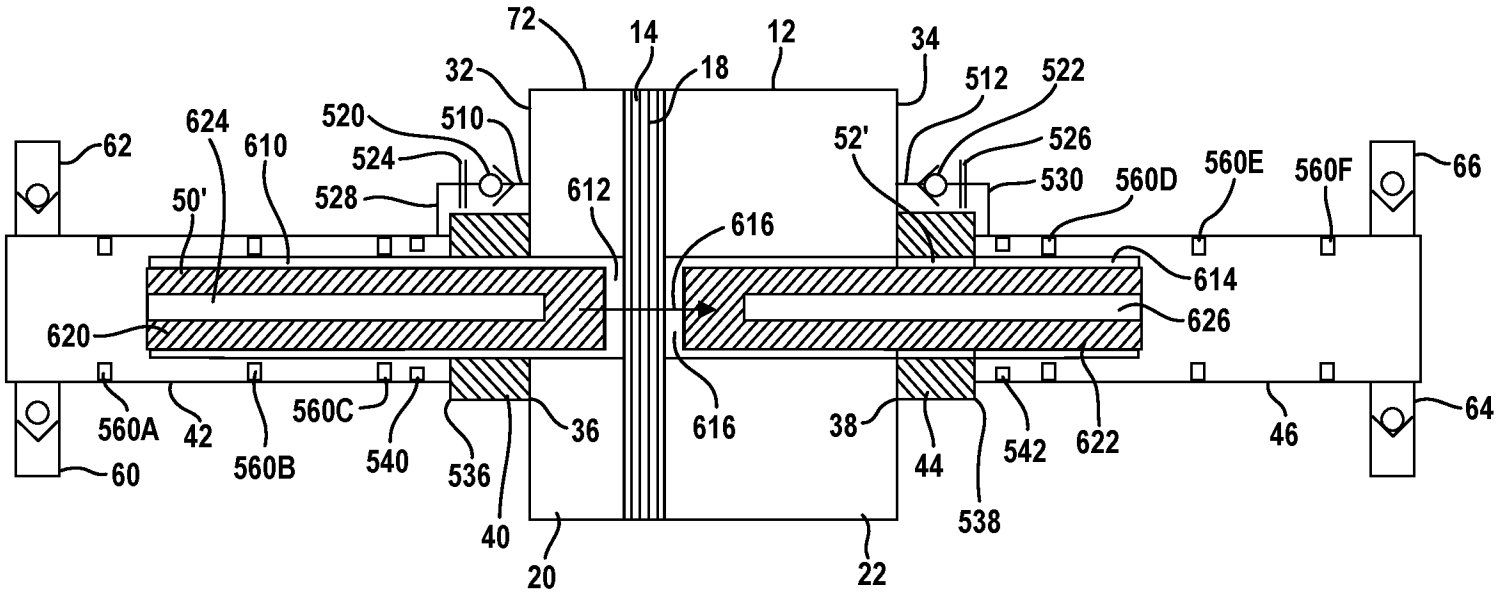
FIG. 6 is a schematic view of an improved plunger to reduce pressure variation within the barrel.

Referring now to FIG. 6, an alternative arrangement of the plungers 50 and 52 are illustrated at 50' and 52'. In this embodiment, the plungers 50' and 52' are hollow. That is, the plunger 50' has an outer cylindrical wall 610 and an end wall 612 that is coupled to the piston 14. Plunger 52' has a cylindrical wall 614 and an end wall 616. The end walls 612 and 616 may also be integrally formed with the face of the piston 14. Because of the rapid depressurization within the volumes 20, 22 of the cylinder 12, and the rapid change in the flow of velocities within the barrels 42, 46, pressure spikes may highly stress various components. A liner 620 may be formed within the plunger 50'. A liner 622 may be formed within the plunger 52'. The liner 620 may be formed from a foam material to reduce the rapidity of the pressurization. The liners 620, 622 may have an axially extending central passage 624, 626, respectively. The central passages 624, 626 allow fluid to be in contact with the length of the foam liners 620, 622. As the barrels 42 and 46 are pressurized, the liners 620, 622 compress to reduce the rapidity of pressurization. When the barrels 42 and 46 are depressurized, the foam liners 620 and 622 depressurize and expand to reduce the rapidity of depressurization. The foam liners 620 and 622 may extend completely to the end walls 612, 616, respectively, or the foam liners 620, 622 may extend in an axial direction adjacent to the end walls 612, 616.

Figure 7A:
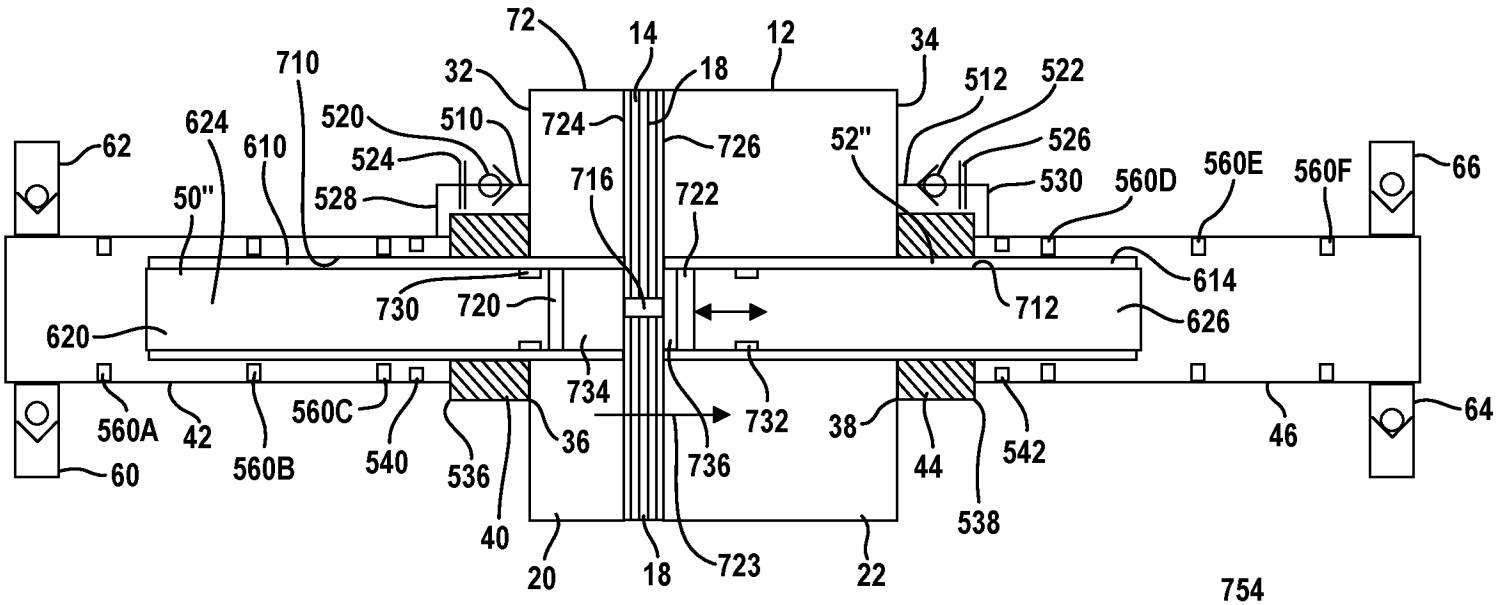
FIG. 7A is a schematic view of another embodiment for reducing pressure spikes within a barrel using an improved plunger.

Referring now to FIG. 7A, another embodiment of the cylinder and barrel portion of the system is set forth. In this example, the plungers 50" and 52" have been modified to be dampers to reduce pressure spikes during pressurization and depressurization. In this example, the plungers 50' and 52" are generally hollow and are formed by an outer wall 710 and 712, respectively. The outer wall 710 may extend to the piston 14. The outer wall 710, 712 may be cylindrical and hollow in a similar manner to that described above with respect to FIG. 6. The wall 710, 712 may be affixed to the surface of the piston 14. Within the confines of the walls 710 and 712, an orifice passage 716 may couple the first side of the piston 14 to the second side of the piston 14. A first plunger piston 720 is disposed within the outer wall 710. A second plunger piston 722 is disposed within the outer wall 712. The first plunger piston 720 and the second plunger piston 722 move in an axial direction as illustrated by arrow 723 between the first face 724 of the piston 14 and a second face 726 of the piston 14, respectively.

Figure 7B:
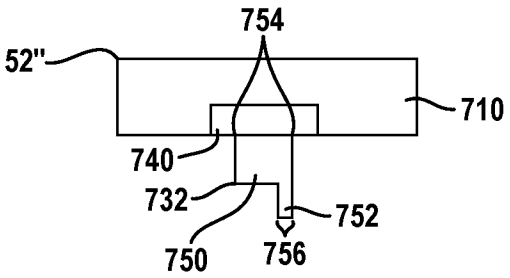
FIG. 7B is a cross-sectional view of an improved sealing ring and barrel.

Referring now also to FIG. 7B, the axial travel limit of the piston 720, 722 are bounded between the face of the piston and the rings 730 and 732. The ring 732 is illustrated in further detail in FIG. 7B. Between the plunger pistons, a volume 734 is positioned therebetween. A first volume 734 is shown adjacent to the plunger piston 720 and a second volume 736 is shown adjacent to the plunger piston 722.

The rings 730 and 732 are formed to limit the travel of the pistons in an axial direction. A partial circumferentially disposed notch 740 may be formed in the outer wall 710 of the plunger 52" to allow fluid to pass around the piston 722. The notch 740 extends a limited direction around the circumference of the interior of the plunger 52".

As the piston 14 moves back and forth, the pressures within the barrels 42 and 46 change. The pressures allow the plunger pistons 720, 722 to move in a corresponding manner. The orifice passage 716 allows water or other hydraulic fluid to pass between the volumes 734 and the volumes 736. In this example, as the pressure in the barrel 46 rises, the plunger piston 722 is driven toward the surface 726 of the piston 14. Fluid is forced through the orifice 716 and pushes the piston 720 toward the ring 730. When the plunger piston 722 reaches the face 726 of the piston 14, no further flow can pass through the orifice passage 716. When the spool valve changes state and pressure rises in the barrel 42, pressure decreases within the barrel 46 causing the piston 720 to be driven toward the surface 724 of the piston 14. The flow resistance through the orifice passage 716 reduces the rapidity of pressure rise in the barrel 42 and reduces the rapidity of pressure decrease in the barrel 46.

Referring now specifically to FIG. 7B, the ring 732 is illustrated in further detail. The ring 732 has a first portion 750 that extends axially from the wall 710. A second portion 752 extends in a radial direction from the first portion 750 and away from the wall 710. The width 754 of the first portion 750 is less than the axial width 756 of the second portion 752. The difference in the width allows a seal to be formed with the plunger piston 722 as the plunger 52" moves in the rightward direction indicated by the arrow 723 in FIG. 7A. The flow of fluid through the notch 740 also ceases as the plunger piston 722 contacts the surface 726 of the piston 14. The same is true with respect to the plunger piston 720 and the ring 730 which may be formed in a similar manner to that illustrated in FIG. 7B.

Figure 8:
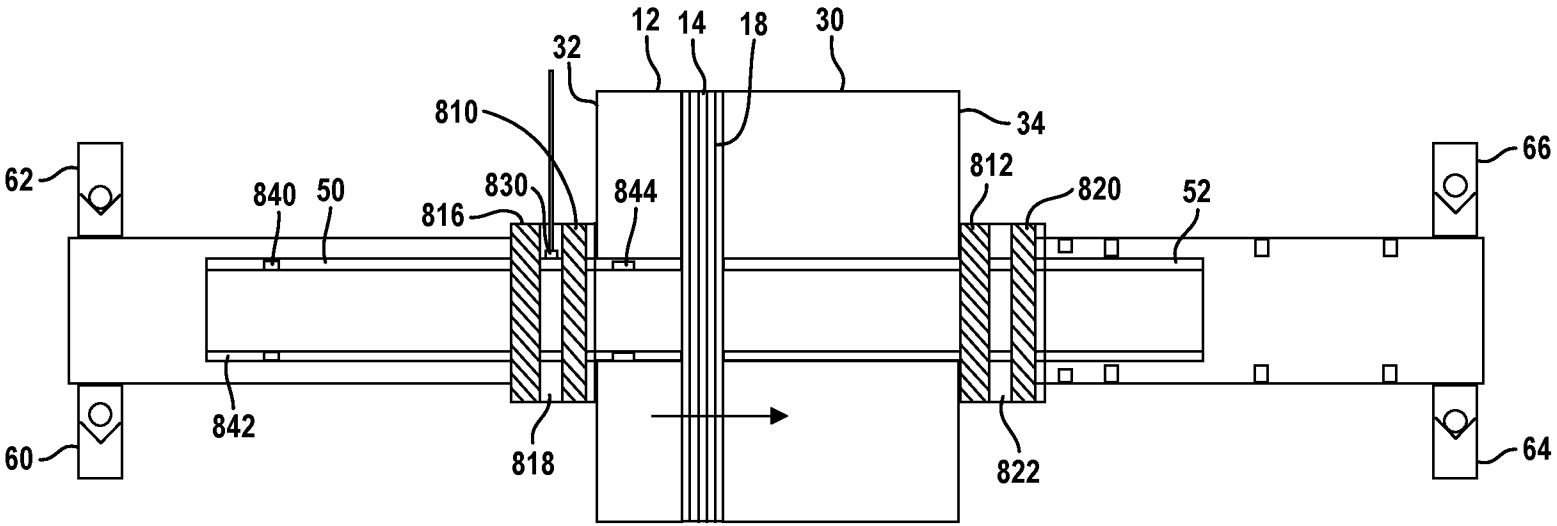
FIG. 8 is a schematic view of a position sensing system for the plunger.

Referring now to FIG. 8, monitoring at the interface between the cylinder 12 and the barrels 42 and 46 is set forth. The seals 40 and 44 set forth above have been replaced with a plurality of spaced apart seals. In this example, a first seal 810 is disposed directly adjacent to the first end 32 of the cylinder 12 where the plunger 50 extends therefrom. Likewise, a seal 812 is directly adjacent to the second end 34 of the cylinder 12 where the plunger 52 extends from the cylinder 12. A second seal 816 is spaced apart from the first seal 810 by a gap 818. Likewise, a second seal 820 is spaced apart from the first seal 812 by a gap 822. The gaps 818, 822 are sized to allow a sensor 830 to be disposed therein. The sensor 830 may sense the presence of a magnetic field thereby. The gaps 818 and 822 allow visual inspection to monitor for leakage of slurry between the cylinder and the plungers 50 and 52. The magnets described may be referred to as an actuator because they actuate the sensor 830. A magnet 840 may be embedded or coupled to the wall 842 of the plunger 50. The wall 842 may also have a second magnet 844 coupled therein or thereon. The magnet 840 may be at or near the leftmost end of the plunger 50 as illustrated in FIG. 8. The leftmost end corresponds to the end of the plunger 50 away from the piston 14. The second magnet 844 may be disposed at a second end near the face of the piston 14.

In operation, as the sensor 830 detects the presence of a magnet, a signal is generated for the spool valve to change states. In this example, the proximity sensors 212 and 214 have been eliminated in the cylinder. This may provide a lower cost alternative to the proximity sensors 212, 214. The positions of the magnets 840 and 844 correspond to the position when the piston 14 is at either end of the cylinder 12. That is, the magnet 840 is positioned so that as the piston 14 is reaching the end wall 34, a signal is generated by the sensor 830. Likewise, the magnet 844 is positioned so that as the position 14 is approaching the wall 32, a signal is generated by the sensor 830 and communicated to the controller. In this manner, the operation of the spool valve may be controlled by the controller 210 (described above) in response to the signal from the sensor 830.

Figure 9A:
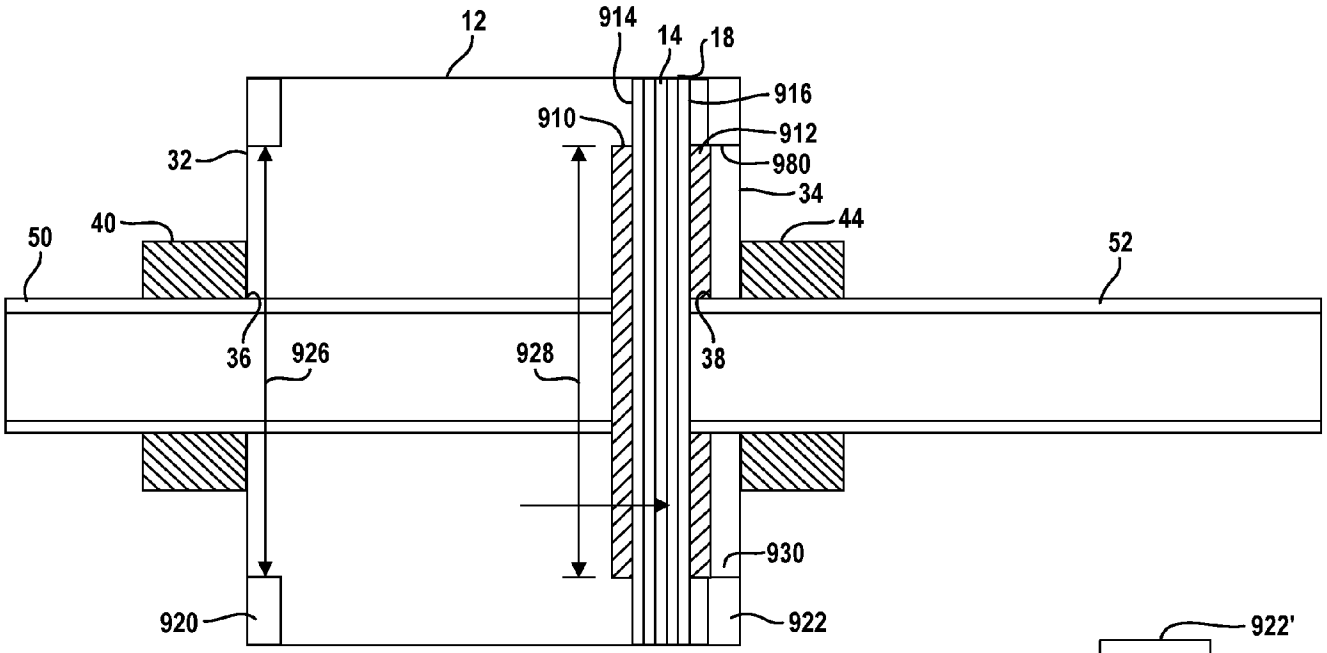
FIG. 9A is a cross-sectional view of a plunger and ring assembly to prevent damage to the piston.
Figure 9B:
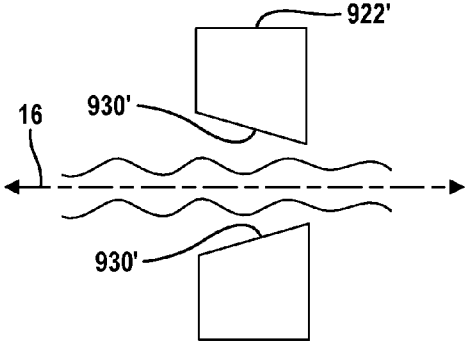
FIG. 9B is another embodiment of a ring for reducing damage to the piston.

Referring now to FIG. 9A and 9B, an example for preventing crashing of piston 14 against the first end wall 32 and the second end wall 34 is set forth. In this example, a first shoulder 910 and a second shoulder 912 are coupled to a respective first side 914 and a respective second side 916 of the piston 14. The shoulders 910, 912 are sized to be received within a ring 920 or 922, respectively. Thus, the cylinder bore is reduced by the rings 920 and 922 and has an inner diameter 926 sized to receive the width 928 of the shoulder 910. Each shoulder 910, 912 may have the same width 928. Each ring 920, 922 may have the same inner diameter bounded by faces 930. As the piston 14 approaches the end wall 32, the shoulder 910 enters the diameter 926 within the ring 920 which causes a rapid pressure rise resulting in a force that resists or stops the piston 14. Likewise, the shoulder 912 being received within the inner diameter of the ring 922 also creates a counterforce. The counterforce prevents the piston 14 from slapping against the walls 932 or 934 depending on the direction. This may prevent damage if a proximity sensor or magnetic sensor fails. The shoulder 928 and ring 922 may be formed of various materials including a rubber material.

Referring now to FIG. 9B, the ring 922 may be configured with straight vertical and horizontal sides as set forth in FIG. 9A. However, an alternative design to the ring 922 is illustrated as 922'. In this example, a tapered face 930' provides a gradual increase in pressure as the piston shoulder 912 extends therein.

Figure 10B:
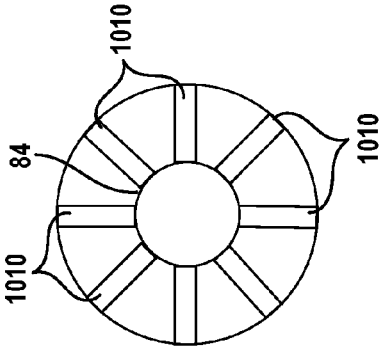
FIGS. 10A, 10B and 10C illustrate flutes coupled to a rod within a spool valve.
Figure 10A:
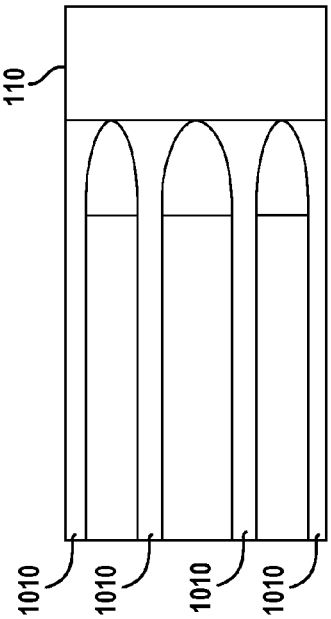
Figure 10C:
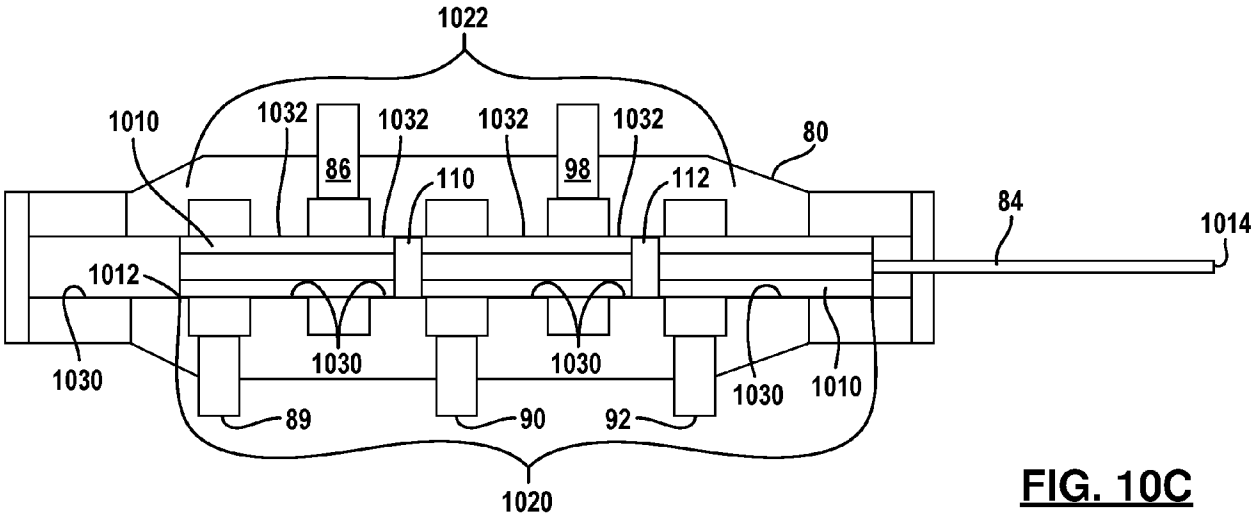

Referring now to FIGS. 10A, 10B and 10C, the rod 84 of the spool valve is set forth in further detail. As mentioned above, the spool valve 80 may include the valve disks 110 and 112. In this example, a plurality of flutes 1010 extends in a radial direction from the rod 84. The flutes 1010 also extend in an axial direction. The flutes may extend between the valve disks 110 and 112 as well as extending toward the end of the rods 84 from the valve disks 110 and 112. That is, as is best illustrated in FIG. 10C, the flutes 1010 may extend to an end 1012 of the rod 84. Likewise, the flutes 1010 may also extend toward a second end 1014 of the rod 84. The length of the flutes 1010 in combination with the valve disks 110 and 112 form an effective length which allows the flutes 1010 to make the rod 84 more rigid during the rapid switches during pressurization and depressurization. The effective length 1020 of the flutes in combination with the valve disks 110 and 112 are sized to be greater than the length between the outer ports 1022. The flutes 1020 are positioned to rest against the spindle bore 1030 formed within the spool valve 80. The flutes 1010 may engage the spindle bore 1030 along its entire length to ensure the valve disks are aligned precisely with the bore to eliminate unnecessary rubbing as the valve disks 110, 112 enter the spindle bore sealing areas between the spindle valve ports 86, 88, 90 and 92.

Figure 11:
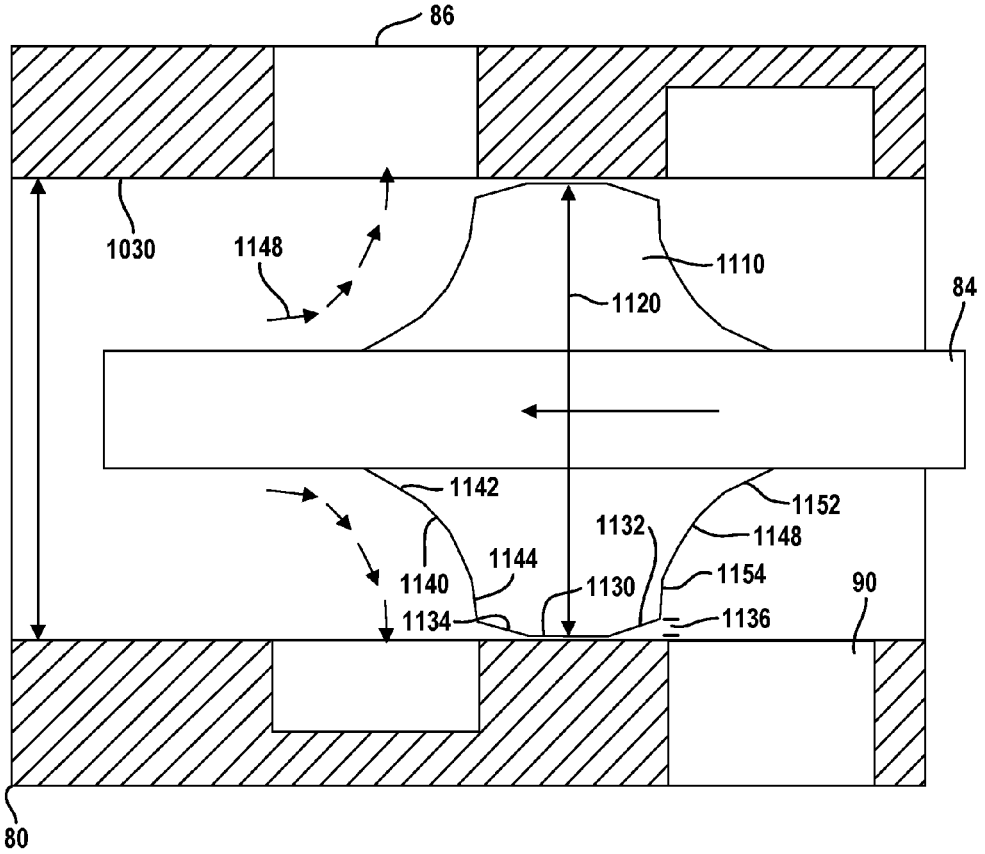
FIG. 11 is a cross-sectional view of an improved valve disk.

Referring now to FIG. 11, the spindle bore 1030 is illustrated in further detail relative to a valve disk 1110. In this example, valve port 86 and valve port 90 of FIG. 1 are illustrated in further detail. In this example, the shape of the disk 110 allows high volumes to travel through to the various ports. The various valve disks may be formed in this manner to improve the flow of fluid through the spool valve 80. The valve disk 110 has a first diameter 1120 that corresponds to the diameter 1122 of the spindle bore 1030. A first surface 1130 extends in an axial direction and is formed parallel to the spindle bore 1030. The surface 1130 may form the seal between the spindle bore 1030 and the valve disk 1110. A second surface 1132 and a third surface 1134 may be tapered surface that extend from the first surface 1130 a distance 1136 away from the spindle bore 1030 toward the rod 84. Surfaces 1132 and 1134 are tapered surfaces. As the tapered surfaces 1132 and 1134 move across the ports 86 and 90, a slight leakage takes place which ensures a more gradual change in pressure and reduces the rapidity of the pressure change and therefore prevents erosion of the valve seal area.

A fourth surface 1140 has a generally axial extending area 1142 and a radially extending area 1144. The surface area 1144 is directly adjacent to surface 1134. The surface 1140 thus transitions from an axial extending surface 1142 to the radially extending surface 1144. The surface 1140 may thus be a radius or a curved surface. The curved surface 1140 allows the fluid indicated by arrows 1148 to be directed into the associated ports such as port 86 in FIG. 11. By providing a constant radius of surface 1140, turbulence and pressure losses associated with high flow rates are reduced. The surface 1150 may also be formed in the same way as surface 1140 with an axially extending portion 1152 and a generally radially extending portion 1154.

Figure 12A:
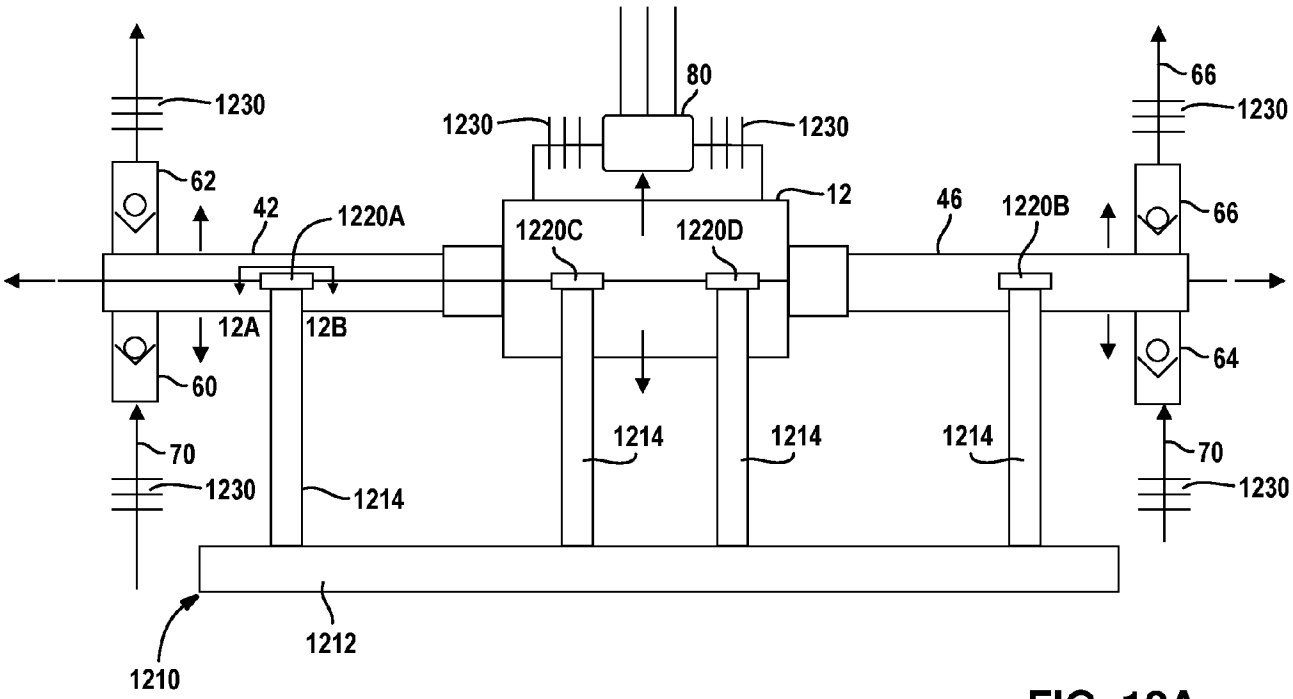
FIG. 12A is a schematic view of a mounting system for the pressure intensifier system.
Figure 12B:
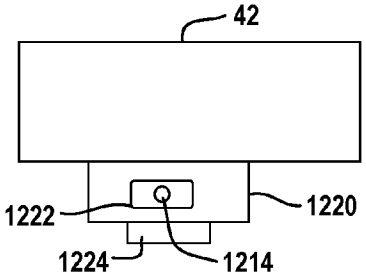
FIG. 12B is an enlarged view of FIG. 12A.

Referring now to FIGS. 12A and 12B, the cylinder 12 and the pump barrels 42 and 46 may be supported with a support structure 1210. The support structure 1210 may include a base plate 1212 and a plurality of pedestals 1214 extending therefrom. The pedestals 1214 may extend in a vertical direction and the base 1212 may extend in a horizontal direction. The coupling of the pump barrels 42, 46 to the pedestals 1214 allow for operating during cycles to prevent axial and radial stresses in the various components. The barrels 42, 46 have tabs 1220A, 1220B that extend therefrom. The tabs 1220C and 1220D extend from cylinder 12. The tabs 1220A-D are collectively referred to as tab 1220. The tabs 1220 have a slot 1222 that receives a pin 1224 that extends from each pedestal 1214. The pin 1224 floats within the slot 1222 so that during axial and radial stresses, the pedestal 1214 does not confine the movement of the barrels 1242, 1246 or the cylinder 12. Thus, both radial and axial expansion of the system may be provided at the components so that stresses do not reduce the life cycle of the various components.

Because the parts may slightly move, flexible pipe joints 1230 may be formed in the various connections to the various manifolds such as the manifold 70 and the manifold 72.

The spool valve 80 may also be coupled to the cylinder 12 with flexible pipe joints 1230.

In operation, a diesel engine may be used to drive the pump 96 in a hydraulic fracking operation. The speed of the diesel engine may be adjusted to provide the proper output of pressure desired by the process.

Also, the plungers 50, 52 may have an increased stroke compared to that known in previously formed hydraulic fracking operations. For example, 60 inches of stroke may be formed rather than commonly found 10 inches. Because of this, the valves and the seals are subjected to one-sixth the number of cycles for a given volume.

A steady plunger velocity is also provided. The peak velocity is essentially the same as the average velocity and thus component wear is reduced. Plunger reversal is gradual than commonly found systems and therefore the closing force and impact on the various check valves set forth in the system is reduced. This improves the valve life. Further, isolation of the seals extends the life of the seals and eliminates plunger wear from the rubbing of the abrasives. Several improvements are set forth in the above paragraphs. The individual improvements may be combined in various manners in one single improved system. Although, the various teachings set forth above may be performed above individually and may also be used outside of the hydraulic fracking industry.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A pressure intensifier system comprising:

a housing comprising a piston therein, said piston defining a first volume and a second volume within the housing;

a high pressure pump;

a low pressure manifold coupled to a drain line and a slurry tank the drain line is connected to a drain;

a plurality of valves selectively coupling the high pressure pump to the first volume or the second volume and selectively coupling the first volume to the low pressure manifold, said plurality of valves comprising a first state coupling the high pressure pump to the first volume and coupling the second volume to the low pressure manifold so that a first portion of fluid in the second volume is in communication with the slurry tank and a second portion of the fluid is in communication with the drain, said plurality of valves comprising a second state coupling the high pressure pump to the second volume and coupling the first volume to the low pressure manifold so that a first portion of fluid in the first volume is in communication with the slurry tank and a second portion of the fluid in first volume is in communication with the drain.

2. The pressure intensifier system of claim 1 wherein the high pressure pump comprises a centrifugal pump.

3. The pressure intensifier system of claim 2 wherein the high pressure pump comprises a multistage centrifugal pump.

4. The pressure intensifier system of claim 1 wherein the drain is coupled to a source tank and wherein the high pressure pump is fluidically couple to the source tank.

5. The pressure intensifier system of claim 1 wherein the first volume and the second volume are selectively coupled to the slurry tank through a flow sensor and a flow regulation valve.

6. The pressure intensifier system of claim 5 further comprising a dry material hopper for communicating dry material to the slurry tank.

7. The pressure intensifier system of claim 5 wherein the slurry tank is coupled to a low pressure pump, said low pressure pump communicating slurry to a first pump barrel and a second pump barrel through a first check valve and a second check valve.

8. The pressure intensifier system of claim 1 further comprising a controller and a first proximity sensor generating a first proximity signal corresponding a first proximity of the piston relative to a first end of the housing and a second proximity sensor generating a second proximity signal corresponding to a second proximity of the piston relative to a second end of the housing.

9. The pressure intensifier system of claim 8 wherein the controller controls a flow of fluid from the low pressure manifold to the slurry tank based on a flow signal from a flow rate sensor by controlling a flow regulation valve.

10. The pressure intensifier system of claim 1 wherein the plurality of valves are disposed in a spool valve.

11. The pressure intensifier system of claim 1 wherein the housing comprises a first end having a first pump barrel extending therefrom and a second end having a second pump barrel extending therefrom, said first end comprising a first seal, said second end comprising a second seal, said piston comprising a first plunger extending from the first end through the first seal and into the first barrel and a second plunger extending from the second end through the second seal and into the second barrel.

12. The pressure intensifier system of claim 11 wherein the housing comprises a first passage communicating fluid from the first volume to the first barrel through a first check valve and said housing comprising a second passage communicating fluid from the second volume to the second barrel through a second check valve.

13. The pressure intensifier system of claim 12 wherein the first passage comprises a first orifice limiting a first flow therethrough and wherein the second passage comprises a second orifice limiting a first flow therethrough.

14. The pressure intensifier system of claim 11 wherein the first pump barrel and the second pump barrel alternately couple high pressure slurry to an outlet pipe.

15. The pressure intensifier system of claim 11 wherein the first plunger is coupled within the first barrel with a first plurality of guide rings and wherein the second plunger is coupled within the second barrel with a second plurality of guide rings.

16. The pressure intensifier system of claim 15 wherein the first barrel, the first plurality of guide rings and the first plunger are coaxial and wherein the second barrel, the second plurality of guide rings and the second plunger are coaxial.

17. The pressure intensifier system of claim 15 wherein the first plurality of guide rings and the second plurality of guide rings comprises a plurality of nodes forming fluid passages therebetween.

18. The pressure intensifier system of claim 11 wherein the first pump barrel is hollow and comprises a first cylindrical wall comprising a first open end, wherein the second pump barrel is hollow and comprises a second cylindrical wall comprising a second open end.

19. The pressure intensifier system of claim 18 wherein the first pump barrel comprises a first foam liner disposed directly adjacent to the first cylindrical wall.

20. The pressure intensifier system of claim 19 wherein the first foam liner comprises a central passage in fluid communication with the first pump barrel.

21. The pressure intensifier system of claim 19 wherein the second pump barrel comprises a second foam liner disposed directly adjacent to the second cylindrical wall.

22. The pressure intensifier system of claim 21 wherein the second foam liner comprises a central passage in fluid communication with the second pump barrel.

23. The pressure intensifier system of claim 18 wherein the piston comprises an orifice passage coupling a first plunger volume defined with a first plunger piston disposed within the first cylindrical wall and the piston and a second plunger volume defined between a second plunger piston disposed within the second cylindrical wall and the piston.

24. The pressure intensifier system of claim 23 further comprising a first limit ring limiting axial movement of the first plunger piston and a second limit ring limiting axial movement of the second plunger piston.

25. The pressure intensifier system of claim 24 wherein, in a first plunger piston state, said first plunger piston is disposed at the first limit ring and the second plunger piston blocks the orifice passage and wherein, in a second plunger piston state, said second plunger piston is disposed at the second limit ring and the first plunger piston blocks the orifice passage.

26. The pressure intensifier system of claim 25 wherein the first cylindrical wall comprises a first notch providing a first fluid passage around the first limit ring, wherein fluid through the first fluid passage is blocked when the second plunger piston blocks the orifice passage.

27. The pressure intensifier system of claim 26 wherein the second cylindrical wall comprises a second notch providing a second fluid passage around the second limit ring, wherein fluid through the second fluid passage is blocked when the first plunger piston blocks the orifice passage.

28. The pressure intensifier system of claim 11 wherein the first seal comprises a first portion and a second portion separated by a first air gap, said first air gap comprising a first sensor and the first plunger comprises a first sensor actuator disposed at a first end of the first plunger and a second sensor actuator disposed at a second end of the first plunger.

29. The pressure intensifier system of claim 28 wherein the first sensor actuator comprises a first magnet and the second sensor actuator comprises a second magnet.

30. The pressure intensifier system of claim 28 further comprising a controller coupled to the first sensor, said controller controlling the plurality of valves in response to the sensor sensing the first sensor actuator or the second sensor actuator.

31. The pressure intensifier system of claim 1 wherein the housing comprises a first end axially spaced apart from a second end, said piston comprises a first side comprising a first shoulder axially extending toward the first end, and a second side comprising a second shoulder axially extending toward the second end.

32. The pressure intensifier system of claim 31 further comprising a first ring disposed on the first end and a second ring disposed on the second end, said first shoulder and the first ring cooperating to prevent the piston from contacting the first end and said second shoulder and the second ring cooperating to prevent the piston from contacting the second end.

33. The pressure intensifier system of claim 32 wherein the first ring and the first shoulder form a first close clearance volume therebetween for resisting axial thrust.

34. The pressure intensifier system of claim 33 wherein the second ring and the second shoulder form a second close clearance volume therebetween for resisting axial thrust.

35. The pressure intensifier system of claim 33 wherein the first ring comprises a bore receiving the first shoulder, said bore being tapered.

36. The pressure intensifier system of claim 1 wherein the plurality of valves comprise a spool valve having a spindle bore having a first diameter, said spool valve comprising a rod extending at least partially therethrough, said rod comprising a first valve disk having an second diameter corresponding the first diameter, said rod comprising a plurality of radially extending flutes, wherein said radially extending flutes extend coaxially with the rods.

37. The pressure intensifier system of claim 36 wherein an outer diameter of the flutes corresponds to the first diameter.

38. The pressure intensifier system of claim 36 wherein the flutes extend between the first valve disk and a second valve disk spaced apart from the first valve disk.

39. The pressure intensifier system of claim 36 wherein the flutes are integrally formed with the rod.

40. The pressure intensifier system of claim 36 wherein the flutes extend a length corresponding to at least a distance between end ports of the spool valve.

41. The pressure intensifier system of claim 1 wherein the plurality of valves comprise a spool valve having a spindle bore having a first diameter, said spool valve comprising a rod extending at least partially therethrough, said rod comprising a first valve disk having a first surface having an second diameter corresponding the first diameter, said first valve disk comprising a second surface and a third surface directly adjacent to the first surface, said third surface comprising a first taper and said second surface comprising a second taper.

42. The pressure intensifier system of claim 41 wherein said first valve disk comprising a fourth surface extending between the rod and the second surface, said fourth surface comprising a radius.

43. The pressure intensifier system of claim 42 wherein the fourth surface transitions from axial to radial.

44. The pressure intensifier system of claim 42 wherein said first valve disk comprising a fifth surface extending between the rod and the third surface, said fifth surface comprising the radius.

45. The pressure intensifier system of claim 44 wherein the fifth surface transitions from axial to radial.

46. The pressure intensifier system of claim 11 further comprising a mounting tab extending from the first pump barrel.

47. The pressure intensifier system of claim 46 wherein the mounting tab comprises a slot extending in a parallel direction to an axis of the first pump barrel, and further comprising a pedestal comprising a pin extending from the pedestal, said pin being received within the slot.

48. The pressure intensifier system of claim 47 wherein the pin is received within the slot to accommodate axial and radial movement of the barrel.

49. The pressure intensifier system of claim 47 wherein the pedestal extends in a vertical direction.

50. The pressure intensifier system of claim 47 wherein the pedestal extends from a baseplate.

51. The pressure intensifier system of claim 1 further comprising a plurality of pedestals, each pedestal comprising a respective tab and further comprising a plurality of barrels, wherein each tab is fixedly coupled to one of the plurality of barrels, each tab comprising a slot extending in a parallel direction to an axis of the barrel, wherein each of the plurality of pedestals comprises a pin extending therefrom and being received within the slot.

52. The pressure intensifier system of claim 51 wherein the plurality of pedestals are coupled to a base.

* * * * *